US011910988B2

(12) United States Patent
Zhong et al.

(10) Patent No.: US 11,910,988 B2
(45) Date of Patent: Feb. 27, 2024

(54) DUST COLLECTING DEVICE AND CLEANING ROBOT SYSTEM

(71) Applicant: SHENZHEN SILVER STAR INTELLIGENT GROUP CO., LTD., Shenzhen (CN)

(72) Inventors: Xuesen Zhong, Shenzhen (CN); Wenhai Deng, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 233 days.

(21) Appl. No.: 17/699,431

(22) Filed: Mar. 21, 2022

(65) Prior Publication Data

US 2022/0313041 A1 Oct. 6, 2022

(30) Foreign Application Priority Data

Mar. 30, 2021 (CN) ..... 202110341972.7

(51) Int. Cl.
*A47L 9/14* (2006.01)

(52) U.S. Cl.
CPC ..... *A47L 9/1472* (2013.01); *A47L 9/1409* (2013.01); *A47L 9/1445* (2013.01); *A47L 9/1481* (2013.01); *A47L 2201/00* (2013.01)

(58) Field of Classification Search
CPC .... A47L 9/1472; A47L 9/1409; A47L 9/1445; A47L 9/1481; A47L 2201/00; A47L 9/1436; A47L 9/1463; A47L 11/00; A47L 11/40; A47L 11/4002; A47L 11/4011; A47L 11/4013
See application file for complete search history.

(56) References Cited

U.S. PATENT DOCUMENTS

2018/0177369 A1* 6/2018 Morin ..... A47L 9/1436

* cited by examiner

*Primary Examiner* — David Redding
(74) *Attorney, Agent, or Firm* — IPRO, PLLC

(57) ABSTRACT

A dust collecting device includes a bin, a dust bag assembly, a bin cover, a trigger structure, a detector and a controller. The trigger structure moves between an initial position in which the trigger structure does not trigger the detector and a trigger position in which the trigger structure triggers the detector. When the dust bag assembly is installed in the bin and the bin cover covers the bin, the dust bag assembly and the bin cover respectively pushes the trigger structure, such that the trigger structure moves from the initial position to the trigger position and triggers the detector. The controller is electrically connected with the detector. The controller restricts an operation of the dust collecting device according to an untriggered state of the detector, and releases the operation of the dust collecting device according to a triggered state of the detector.

12 Claims, 7 Drawing Sheets

DUST COLLECTING DEVICE AND CLEANING ROBOT SYSTEM

CROSS-REFERENCE TO RELATED APPLICATIONS

The present disclosure claims priority of Chinese Patent Application No. 202110341972.7, filed on Mar. 30, 2021, titled "DUST COLLECTING DEVICE AND CLEANING ROBOT SYSTEM", the contents of which are incorporated herein by reference.

TECHNICAL FIELD

The present disclosure relates to the technical field of cleaning robots, and in particularly, relates to a dust collecting device and a cleaning robot system.

BACKGROUND

A dust collecting device usually includes a bin, a dust bag assembly capable of being placed in and taken out from the bin and a bin cover capable of covering the bin. Before the dust collecting device works, it is necessary to check whether the dust bag assembly is installed in place. In view of this, the existing dust collecting device is usually provided with a position sensor to independently detect whether the dust bag assembly is installed in place, so as to prevent the case where the dust bag is not installed in place when the dust collecting device is started. However, the function of the position sensor in the current dust collecting device is relatively simple, and it is impossible to detect the situation where the dust bag assembly is installed in place but the bin is not covered by the bin cover, which leads to malfunction and poor use performance of the dust collecting device.

SUMMARY

An embodiment of the present disclosure provides a dust collecting device. The dust collecting device includes a bin, a dust bag assembly, a bin cover, a trigger structure, a detector and a controller. The dust bag assembly is detachably installed in the bin. The bin cover is capable of covering or opening the bin. The trigger structure, the detector and the controller are arranged in the bin. The trigger structure is moveable between an initial position in which the trigger structure does not trigger the detector and a trigger position in which the trigger structure triggers the detector. When the dust bag assembly is installed in the bin and the bin cover covers the bin, the dust bag assembly and the bin cover respectively pushing the trigger structure, such that the trigger structure moves from the initial position to the trigger position and triggers the detector. The controller is electrically connected with the detector, the controller restricts an operation of the dust collecting device according to an untriggered state of the detector, and the controller releases a restriction on the operation of the dust collecting device according to a triggered state of the detector.

BRIEF DESCRIPTION OF THE DRAWINGS

In order to explain technical solutions in embodiments of the present disclosure more clearly, attached drawings required in the description of the embodiments or the prior art will be briefly introduced below. Obviously, the attached drawings in the following description are only some embodiments of the present disclosure. For those of ordinary skill in the art, other drawings can also be obtained according to these attached drawings without creative labor.

DETAILED DESCRIPTION

Figure 1:
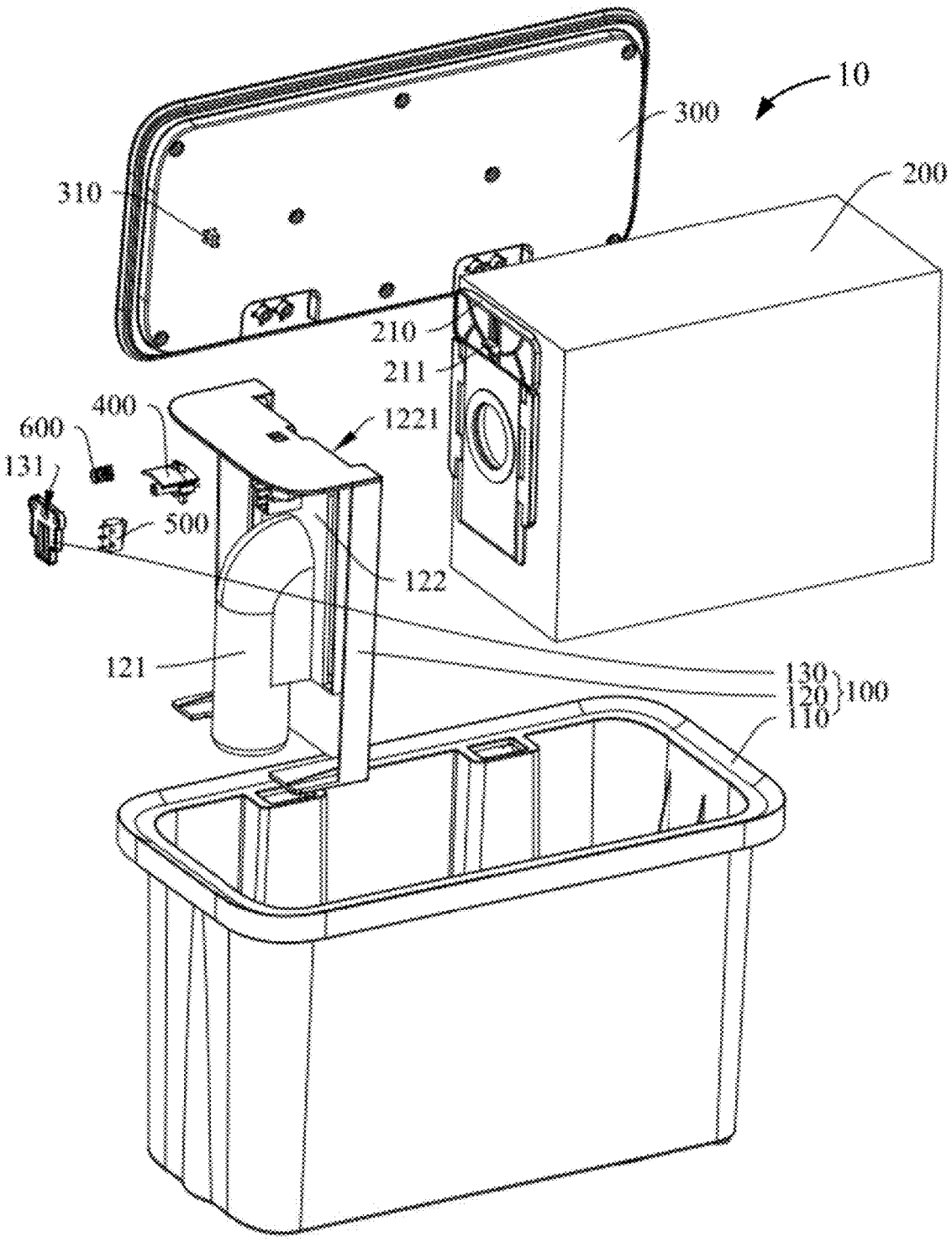
FIG. 1 is an schematic explosive view of a dust collecting device provided by an embodiment of the present disclosure.
Figure 2:
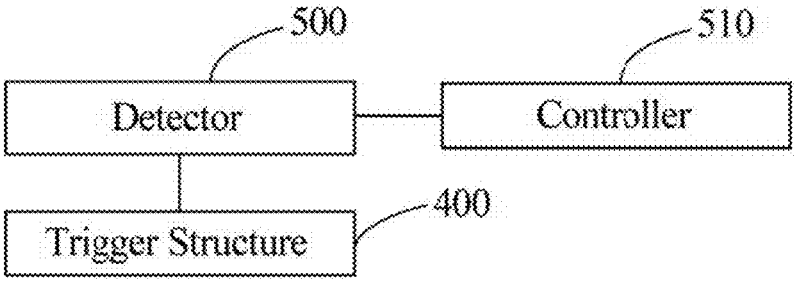
FIG. 2 is a functional block view of a trigger structure, a detector, and a controller of the dust collecting device of FIG. 1.

In order to make the technical problems to be solved by the present disclosure as well as technical solutions and beneficial effects of the present disclosure more clear, the present disclosure will be further described in detail below with reference to the attached drawings and embodiments. It shall be appreciated that the specific embodiments described here are only used to explain the present disclosure, and are not used to limit the present disclosure.

In the description of the present disclosure, it shall be appreciated that, orientations or positional relationships indicated by terms such as "length", "width", "up", "down", "front", "back", "left", "right", "vertical", "horizontal", "top", "bottom", "inside" and "outside" are orientations or positional relationships shown based on the attached drawings, and they are only used for convenience and simplification of description for the present disclosure, and do not indicate or imply that the indicated device or element must have a specific orientation, or be constructed and operated in a specific orientation. Thus, these terms should not be construed as limitation to the present disclosure.

In addition, terms "first" and "second" are only used for descriptive purposes, and should not be construed as indicating or implying relative importance or implicitly indicating the number of technical features indicated. Thus, features defined with "first" and "second" may explicitly or implicitly include one or more of the features. In the description of the present disclosure, "plural" means two or more, unless otherwise specifically defined.

In the present disclosure, unless otherwise specifically specified and defined, terms such as "installation", "linkage", "connection" and "fixation" should be broadly understood. For example, these terms may include fixed connection, detachable connection or integral formation; or they may include mechanical connection or electrical connection; or they may include direct connection or indirect connection achieved through an intermediate medium, or they may include the internal communication of two elements or the interaction between two elements. For those of ordinary skill in the art, the specific meanings of the above terms in the present disclosure can be understood according to specific situations.

The specific implementation of the present disclosure will be described in more detail in combination with specific embodiments hereinafter.

Embodiment 1

Referring to FIG. 1, FIG. 2, FIG. 4 and FIG. 6, an embodiment of the present disclosure provides a dust collecting device 10, including a bin 100, a dust bag assembly 200 detachably installed in the bin 100, a bin cover 300 capable of covering or opening the bin 100, as well as a trigger structure 400, a detector 500 and a controller 510 which are all arranged in the bin 100. The trigger structure 400 is moveable between an initial position and a trigger position, the trigger structure 400 does not trigger the detector 500 at the initial position, and the trigger structure 400 can trigger the detector 500 at the trigger position. When the dust bag assembly 200 is installed in the bin 100 and the bin cover 300 covers the bin 100, the dust bag assembly 200 and the bin cover 300 respectively push the trigger structure 400, such that the trigger structure 400 moves from the initial position to the trigger position and triggers the detector 500. The controller 510 is electrically connected with the detector 500, the controller 510 restricts the operation of the dust collecting device 10 according to the untriggered state of the detector 500, and the controller 510 releases the restriction on the operation of the dust collecting device 10 according to the triggered state of the detector 500.

First, it shall be noted that when the dust collecting device 10 works, the dust bag assembly 200 is placed in the bin 100, and the bin cover 300 covers the bin 100. At this time, impurities such as dust may be introduced into the dust bag assembly 200 through a dust suction pipe 121 of the bin 100. While the dust collecting device 10 stops working, the operator may uncover the bin cover 300 to open the bin 100, then take the dust bag assembly 200 out of the bin 100 and clean up the dust in the dust bag assembly 200. After finishing the cleaning-work, the dust bag assembly 200 may be put back into the bin 100 again for the dust collecting device 10 to operate.

Therefore, before the dust collecting device 10 works, correlated detection regarding whether the dust bag assembly 200 is in place (that is, whether the dust bag assembly 200 is put back into the bin 100) and whether the bin cover 300 covers the bin 100 is achieved through the trigger structure 400 and the detector 500 in this embodiment, and the detection results are fed back to the controller 510, such that the controller 510 restricts the operation of the dust collecting device 10 or releases the restriction on the operation of the dust collecting device 10. This embodiment features a simple structure and good use performance.

Figure 4:
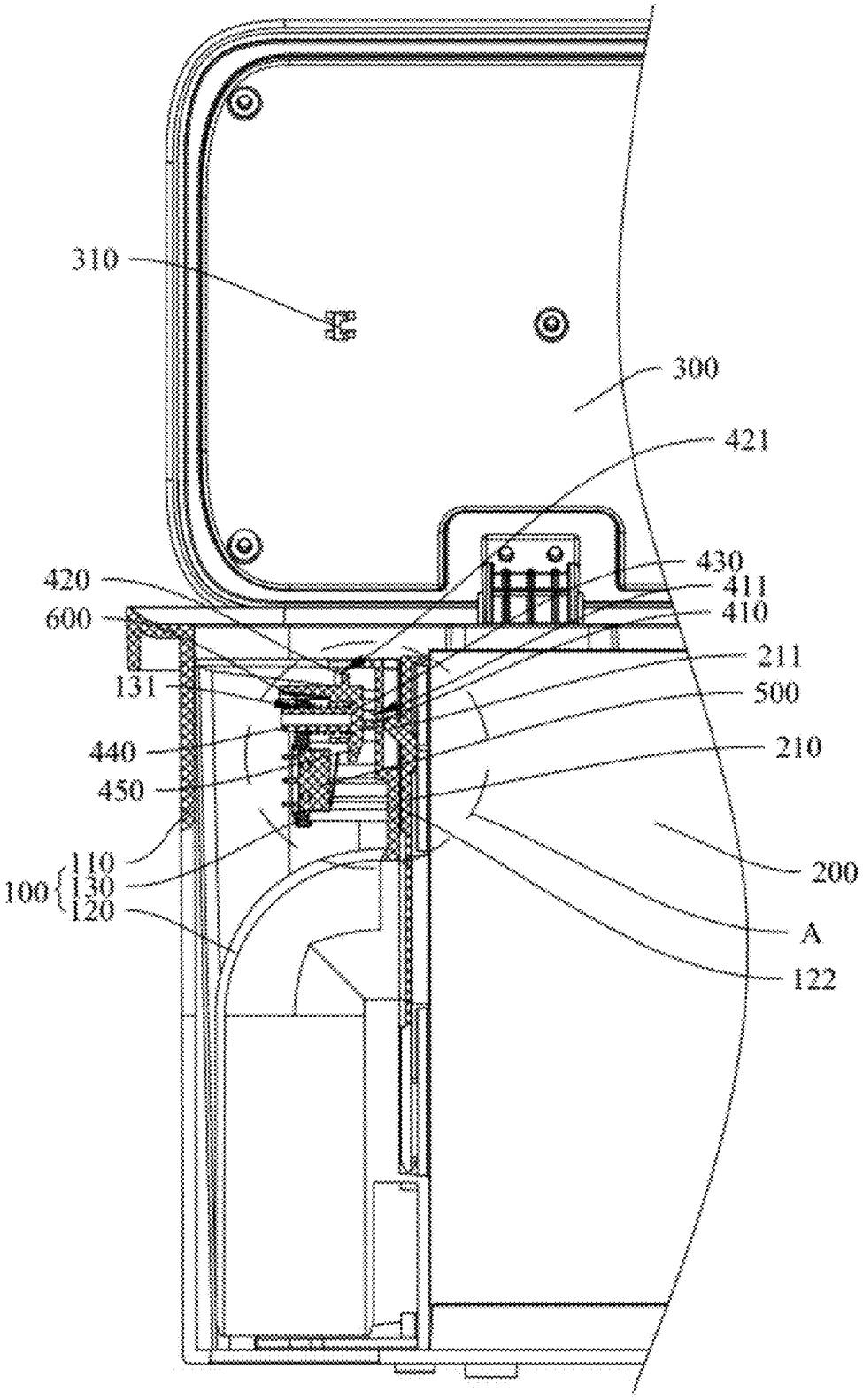
FIG. 4 is a schematic view of the dust collecting device of FIG. 1, the dust collecting device including a dust bag assembly, a bin, and a bin cover, wherein the dust bag assembly is put into the bin but the bin is not covered by the bin cover.
Figure 5:
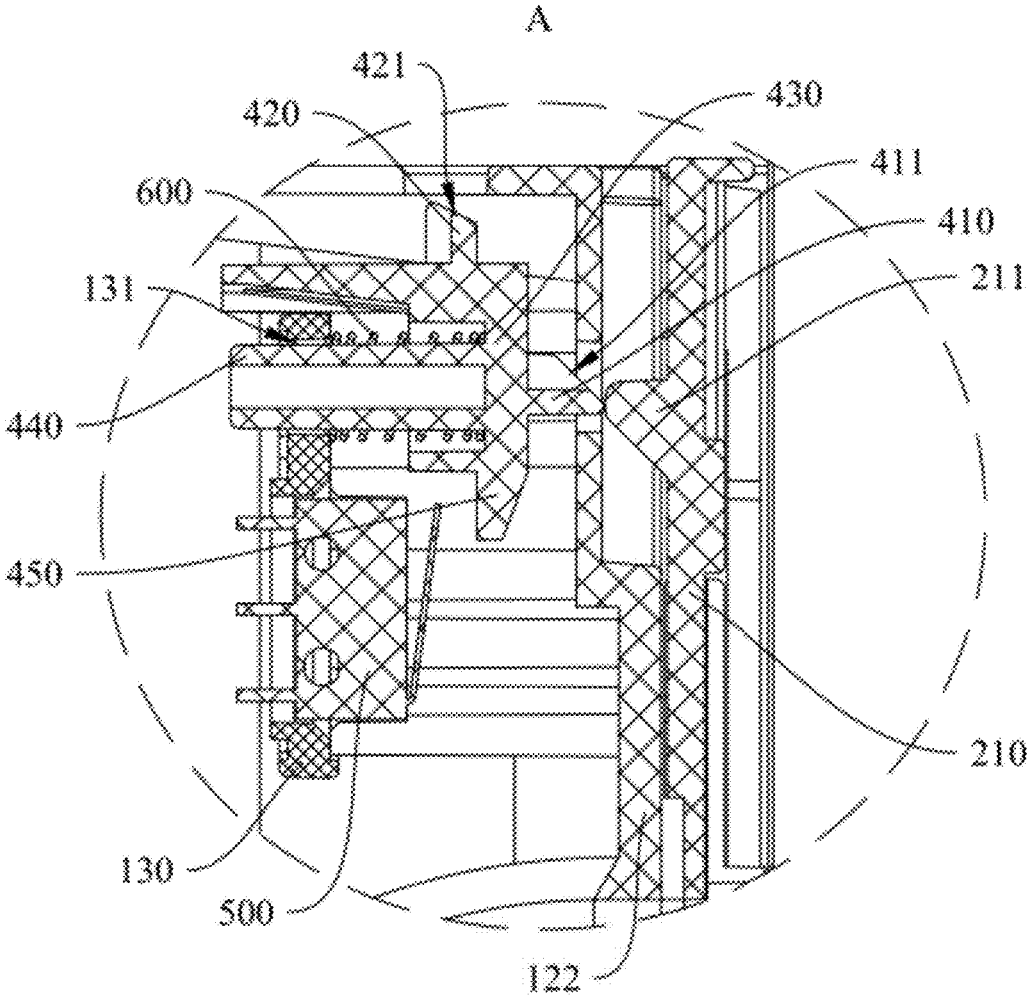
FIG. 5 is an enlarged view of an area A of FIG. 4.
Figure 6:
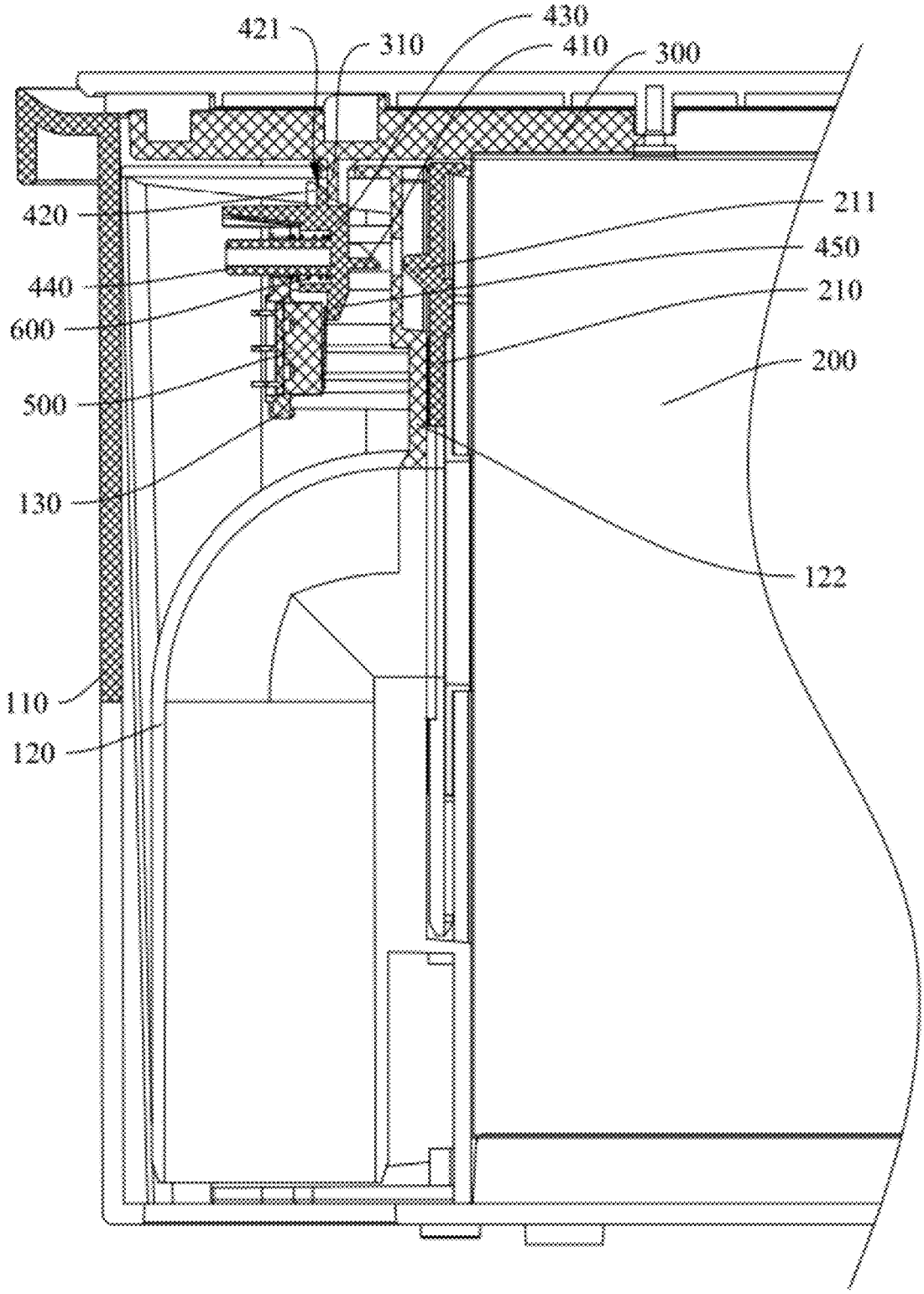
FIG. 6 is a schematic view of the dust collecting device of FIG. 1, wherein the dust bag assembly is put into the bin and the bin is covered by the bin cover.

Specifically, as shown in FIG. 4, FIG. 5 and FIG. 6, when the dust bag assembly 200 is put back into the bin 100 first and then the bin cover 300 covers the bin 100, the trigger structure 400 is pushed by the dust bag assembly 200 and the bin cover 300 in sequence to move from the initial position to the trigger position, the trigger structure 400 triggers the detector 500 at the trigger position, and the controller 510 releases the restriction on the operation of the dust collecting device 10 after obtaining the signal indicating that the detector 500 is in the triggered state. At this time, the dust collecting device 10 is allowed to work or stop working as required.

Figure 7:
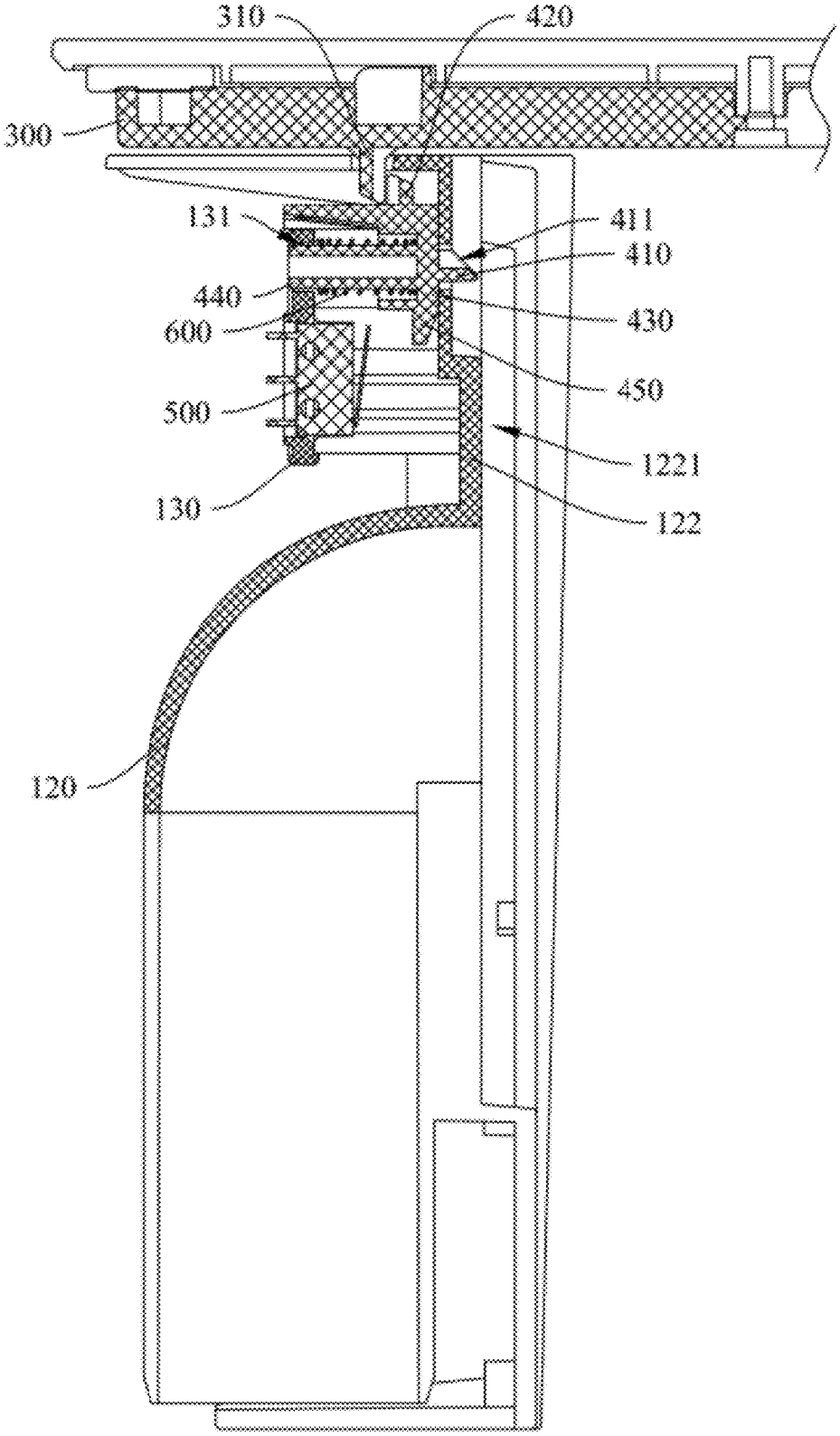
FIG. 7 is a schematic view of the dust collecting device of FIG. 1, wherein the bin is covered by the bin cover but the dust bag assembly is not put into the bin.

On the contrary, as shown in FIG. 7, when the bin cover 300 is uncovered to open the bin 100 and/or the dust bag assembly 200 is taken out from the bin 100, the trigger structure 400 cannot be pushed by the dust bag assembly 200 and the bin cover 300 in sequence, such that it cannot reach the trigger position, and thus cannot trigger the detector 500. During this period, the detector 500 is in the untriggered state, and the controller 510 can continue to restrict the operation of the dust collecting device 10 during the time period in which the signal indicating that the detector 500 is in the untriggered state is obtained until the dust bag assembly 200 is put back into the bin 100 and the bin cover 300 covers the bin 100.

To sum up, the dust collecting device 10 provided by the embodiment of the present disclosure keeps the detector 500 in the untriggered state when the bin cover 300 is uncovered to open the bin 100 and/or the dust bag assembly 200 is taken out from the bin 100, and the controller 510 continuously restricts the operation of the dust collecting device 10 during the time period in which the detector 500 is in the untriggered state. While the dust bag assembly 200 is put back into the bin 100 first and then the bin cover 300 covers the bin 100, the trigger structure 400 is pushed by the dust bag assembly 200 and the bin cover 300 in sequence, such that the trigger structure 400 moves from the initial position to the trigger position and triggers the detector 500. Then, after obtaining the signal indicating that the detector 500 is in the triggered state, the controller 510 can release the restriction on the operation of the dust collecting device 10, allowing the dust collecting device 10 to work or stop working as required. Therefore, the dust collecting device 10 provided by the embodiment of the present disclosure can achieve correlated detection regarding whether the dust bag assembly 200 is in place and whether the bin cover 300 covers the bin 100 through the trigger structure 400 and the detector 500, and then the controller 510 restricts the operation of the dust collecting device 10 or releases the restriction on the operation of the dust collecting device 10 based on the state of the detector 500. Thus, the dust collecting device 10 features a simple structure and a high detection accuracy, and can basically avoid the occurrence of cases where the dust collecting device 10 cannot work normally because the bin 100 is not covered by the bin cover 300 although the dust bag assembly 200 is installed in place, such that the use performance is better.

Optionally, the controller 510 may be a microcontroller unit (MCU). For example, the controller 510 may be an ARM Cortex-M4-32-bit microcontroller, and this is not limited in this embodiment.

Optionally, the detector 500 is pressed by the trigger structure 400 to switch from the untriggered state to the triggered state when the trigger structure 400 is in the trigger position. Specifically, when the trigger structure 400 reaches the trigger position, the trigger structure 400 may press the detector 500 to switch the detector 500 from the untriggered state to the triggered state. On the contrary, when the trigger structure 400 leaves the trigger position, the detector 500 is released from being pressed and switched from the triggered state to the untriggered state. With such arrangement, the switching of the detector 500 between the untriggered state and the triggered state can be realized conveniently, accurately and instantly, and the sensitivity of the state switching of the detector 500 can be improved, thereby improving the detection accuracy.

Optionally, the detector 500 may be a micro switch. With such arrangement, the trigger structure 400 may switch the state of the detector 500 between the untriggered state and the triggered state with a very little force, which can achieve sensitive and immediate state switching operation of the detector 500, thus improving the detection accuracy and sensitivity regarding "whether the dust bag assembly 200 is in place" and "whether the bin cover 300 covers the bin 100", and further improving the use performance of the dust collecting device 10.

Of course, in other possible embodiments, the detector 500 may be toggled by the trigger structure 400 to switch from the untriggered state to the triggered state. The detector 500 may be a Hall sensor, a button switch, a boat switch, a toggle switch or a slide switch or the like, and this is not limited in this embodiment.

Referring to FIG. 4, FIG. 5 and FIG. 6, in this embodiment, the trigger structure 400 may move to the standby position, the standby position is between the initial position and the trigger position, and the trigger structure 400 does not trigger the detector 500 at the standby position. The dust bag assembly 200 is installed in the bin 100 to push the trigger structure 400 to move from the initial position to the standby position, such that the bin cover 300 pushes the trigger structure 400 to continue to move from the standby position to the trigger position when covering the bin 100.

Specifically, the dust bag assembly 200 is first put back into the bin 100. At this time, the trigger structure 400 is pushed by the dust bag assembly 200 to move from the initial position to the standby position. Then, the bin cover 300 covers the bin 100, and the trigger structure 400 is pushed by the bin cover 300 to move from the standby position to the trigger position. The trigger structure 400 may trigger the detector 500 at the trigger position, and the controller 510 releases the restriction on the operation of the dust collecting device 10 after obtaining the signal indicating that the detector 500 is in the triggered state, so as to allow the dust collecting device 10 to work or stop working as required.

If the dust bag assembly 200 is not put back into the bin 100, then the trigger structure 400 cannot reach the standby position. At this time, even if the bin cover 300 covers the bin 100, the bin cover 300 cannot push the trigger structure 400 which is not at the standby position, and thus the detector 500 cannot be triggered by the trigger structure 400. During this period, the controller 510 continues to restrict the operation of the dust collecting device 10 based on the untriggered state of the detector 500 until the dust bag assembly 200 is put back into the bin 100 first and then the bin cover 300 covers the bin 100.

Therefore, with the above scheme, the accuracy of correlated detection regarding whether the dust bag assembly 200 is in place and whether the bin cover 300 covers the bin 100 can be further improved, the risk of misjudgment can be reduced, the dust collecting device 10 can be ensured to work normally as required, and the use performance can be improved.

Figure 3:
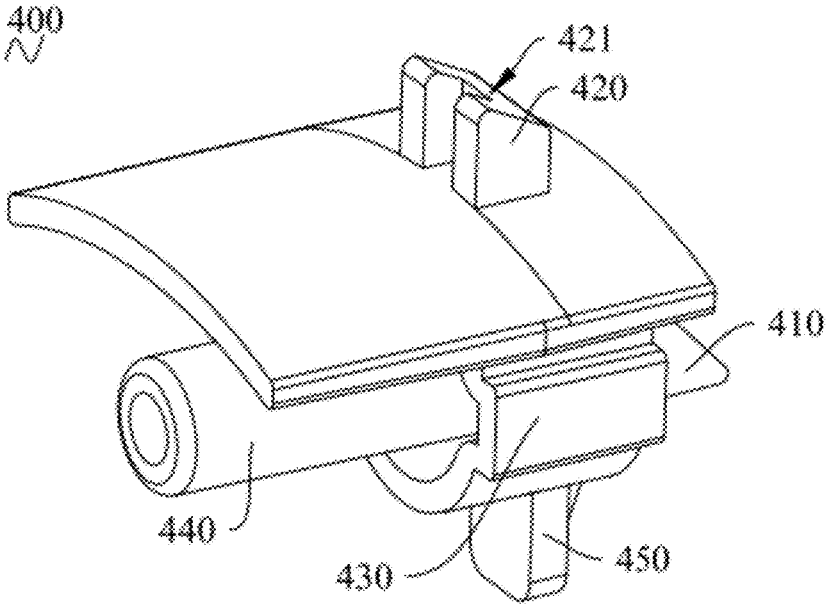
FIG. 3 is a schematic structural view of the trigger structure of FIG. 1.

Referring to FIG. 3, FIG. 5 and FIG. 6, in this embodiment, the trigger structure 400 is provided with a first force bearing part 410, the first force bearing part 410 is located at a side of the trigger structure 400 that is close to the dust bag assembly 200. The dust bag assembly 200 comprises a connection plate 210 detachably connected to the bin 100 and provided with a first force application part 211. The first force application part 211 moves to the initial position as the connection plate 210 is installed in the bin 100, and is configured to push the first force bearing part 410 to move from the initial position to the standby position. The trigger structure 400 is provided with a second force bearing part 420, the second force bearing part 420 is located at a side of the trigger structure 400 that is close to the top of the bin 100, and a side of the bin cover 300 that is close to the top of the bin 100 is provided with a second force application part 310, and the second force application part 310 moves to the standby position as the bin cover 300 covers the top of the bin 100 and is configured to push the second force bearing part 420 to move from the standby position to the trigger position.

Based on the above structure, when the dust bag assembly 200 is put back into the bin 100 and the connection plate 210 is installed in place, the first force application part 211 may relatively push the first force bearing part 410, such that the trigger structure 400 moves from the initial position to the standby position. Then, the bin cover 300 covers the bin 100, and the second force application part 310 may relatively push the second force bearing part 420, such that the trigger structure 400 moves from the standby position to the trigger position, and then triggers the detector 500. Therefore, by adopting the above scheme, the dust bag assembly 200 and the bin cover 300 can be reliably associated with the activities of the trigger structure 400 with a simple structure, and the detection accuracy can be further improved, the risk of misjudgment can be reduced, and the use performance can be further improved.

Referring to FIG. 1, FIG. 5 and FIG. 7, in this embodiment, the bin 100 is provided with an installation sidewall 122 and a plate groove 1221 defined on the installation sidewall 122, the first force bearing part 410 is arranged through the installation sidewall 122 at the initial position, and the connection plate 210 is detachably installed in the plate groove 1221 and attached to the installation sidewall 122, so as to push the first force bearing part 410 to draw back relative to the installation sidewall 122.

By adopting the above scheme, the connection plate 210 can be quickly and accurately installed in place through the engagement of the connection plate 210 and the plate groove 1221, such that it is convenient to guide the dust bag assembly 200 to be placed in place, and it is convenient for the first force application part 211 to relatively push the first force bearing part 410 to move the trigger structure 400 from the initial position to the standby position. Therefore, the assembly convenience of the dust bag assembly 200 and the bin 100 can be improved, and the correlation reliability of the dust bag assembly 200 and the activities of the trigger structure 400 can be improved.

Referring to FIG. 4, FIG. 5 and FIG. 7, in this embodiment, at least one of the first force bearing part 410 and the first force application part 211 is provided with a first guide surface 411, and the first guide surface 411 is obliquely arranged relative to a preset horizontal direction and is configured to guide the first force application part 211 to exert a first horizontal force to the first force bearing part 410.

With the above scheme, during the process of putting the dust bag assembly 200 into the bin 100 from top to bottom, the first force application part 211 may transitionally push and cooperate with the first force bearing part 410 along the first guide surface 411, and gradually push the first force bearing part 410 to draw back relative to the installation sidewall 122, so as to push the trigger structure 400 to move from the initial position to the standby position. Therefore, based on the arrangement of the first guide surface 411, the risk of getting stuck during the cooperation between the first force application part 211 and the first force bearing part 410 can be effectively reduced, the correlation reliability between the dust bag assembly 200 and the activities of the trigger structure 400 can be improved, the smoothness of the activities of the trigger structure 400 can be improved, and the use performance can thus be improved.

The first guide surface 411 on the first force bearing part 410 faces upward and faces the first force application part 211; while the first guide surface on the first force application part 211 faces downward and faces the first force bearing part 410.

Referring to FIG. 3, FIG. 5 and FIG. 6, in this embodiment, at least one of the second force bearing part 420 and the second force application part 310 is provided with a second guide surface 421, the second guide surface 421 is obliquely arranged relative to a preset horizontal direction and is configured to guide the second force application part 310 to exert a second horizontal force to the second force bearing part 420, and the second horizontal force is consistent with the first horizontal force in direction.

Based on the arrangement of the second guide surface 421, during the process that the dust bag assembly 200 has been put into the bin 100 and the bin cover 300 gradually covers the bin 100, the second force application part 310 may transitionally push and cooperate with the second force bearing part 420 along the second guide surface 421, and gradually push the second force bearing part 420 to move from the standby position to the trigger position. Based on this, the risk of getting stuck during the cooperation between the second force application part 310 and the second force bearing part 420 can be effectively reduced, the correlation reliability between the bin cover 300 and the activities of the trigger structure 400 can be improved, the smoothness of the activities of the trigger structure 400 can be improved, and the use performance can thus be improved.

By setting the second horizontal force in the same direction as the first horizontal force, the moving path of the trigger structure 400 from the initial position, the standby position to the trigger position may be basically in a straight line. Based on this, the smoothness of the activities of the trigger structure 400 can be further improved, and this may especially facilitate the reset of the trigger structure 400 and reduce the risk of getting stuck for the trigger structure 400, and improve the reliability and usability.

Referring to FIG. 1, FIG. 5 and FIG. 6, in this embodiment, the first force application part 211 is convexly arranged at a side of the connection plate 210 that is close to the trigger structure 400, and/or the second force application part 310 is convexly arranged at a side of the bin cover 300 that is close to the trigger structure 400.

With the above scheme, the convex first force application part 211 and/or the convex second force application part 310 may reliably and conveniently push the trigger structure 400. Based on this, the correlation reliability between the dust bag assembly 200 and/or the bin cover 300 and the activities of the trigger structure 400 may be further improved, and the activity trip of the trigger structure 400 may be guaranteed or even prolonged, thereby further improving the use performance.

Referring to FIG. 4, FIG. 5 and FIG. 6, in this embodiment, the first force application part 211 pushes the first force bearing part 410 to move from the initial position to the standby position in the first direction, and the second force application part 310 pushes the second force bearing part 420 to move from the standby position to the trigger position in the second direction, wherein the first direction and the second direction are the same preset horizontal direction.

With the above scheme, the moving path of the trigger structure 400 from the initial position, the standby position to the trigger position may be basically in a straight line. Based on this, the smoothness of the activities of the trigger structure 400 can be further improved, and this may especially facilitate the reset of the trigger structure 400 and reduce the risk of getting stuck for the trigger structure 400, and improve the reliability and usability.

Referring to FIG. 3, FIG. 5 and FIG. 6, in this embodiment, the trigger structure 400 is convexly provided with a third force application part 450 configured to press the detector 500.

With the above scheme, the trigger structure 400 can reliably and continuously press the detector 500 through the third force application part 450 at the trigger position, such that the detector 500 maintains the triggered state, and the use performance is better.

Optionally, the detector 500 is arranged at a side of the trigger structure 400 that faces away from the bin cover 300. This arrangement helps to compress the horizontal space occupied by the trigger structure 400 and the detector 500, thus facilitating the miniaturization design of the dust collecting device 10.

Referring to FIG. 1, FIG. 5 and FIG. 6, in this embodiment, the dust collecting device 10 further includes an elastic member 600, and the elastic member 600 is elastically connected with the trigger structure 400 and the bin 100, so as to provide an elastic restoring force for the trigger structure 400 to move in the direction towards the initial position.

It shall be noted here that during the time period in which the trigger structure 400 moves from the initial position to the standby position and then moves from the standby position to the trigger position, the elastic member 600 is elastically deformed and stores the elastic restoring force which makes the trigger structure 400 move in the direction towards the initial position when it is released from being pushed.

Specifically, the bin cover 300 is first uncovered to open the bin 100, and the bin cover 300 releases the push against the trigger structure 400. The elastic force of the elastic member 600 may enforce the trigger structure 400 to reset from the trigger position to the standby position. At this time, the detector 500 has switched from the triggered state to the untriggered state. Then, the dust bag assembly 200 is taken out of the bin 100, and the dust bag assembly 200 releases the push against the trigger structure 400. The elastic force of the elastic member 600 may further enforce the trigger structure 400 to reset from the standby position to the initial position. During this period, the detector 500 always remains in the untriggered state, and the controller 510 keeps the restriction on the operation of the dust collecting device 10 based on the untriggered state of the detector 500 until the dust bag assembly 200 is first put back into the bin 100 and then the bin cover 300 covers the bin 100.

Therefore, with the above scheme, the trigger structure 400 can immediately move in the direction towards the initial position by the elastic restoring force of the elastic member 600 when the bin cover 300 releases the push against the trigger structure 400, such that the trigger of the detector 500 can be immediately released and the detector 500 can be immediately switched back to the untriggered state. In this way, the controller 510 can immediately restrict the operation of the dust collecting device 10, and thus the use performance may be improved. The elastic restoring force of the elastic member 600 can also reset the trigger structure 400 to the initial position, such that it is convenient for correlated detection of the trigger structure 400 and the detector 500 regarding "whether the dust bag assembly 200 is in place" and "whether the bin cover 300 covers the bin 100", thereby improving the detection accuracy, ensuring that the dust collecting device 10 can work normally as required and improving the use performance.

Referring to FIG. 1, FIG. 4 and FIG. 5, in this embodiment, the bin 100 includes a bin body 110, a dust bag bracket 120 and a detection bracket 130, the dust bag bracket 120 is installed in the bin body 110, and the detection bracket 130 is connected to a side of the dust bag bracket 120 that is away from the dust bag assembly 200. The detection bracket 130 defines a limiting hole 131; the trigger structure 400 includes a trigger body 430 and a guide post 440 connected to a side of the trigger body 430 that is away from the dust bag assembly 200, the guide post 440 is slidably fitted in the limiting hole 131, and the elastic member 600 is elastically connected with the trigger body 430 and the detection bracket 130.

First, it shall be noted that the dust suction pipe 121 for communicating with the dust bag assembly 200 may be integrally formed with the dust bag bracket 120, while the trigger structure 400, the detector 500 and the elastic member 600 may be correspondingly assembled to the detection bracket 130, and then the assembly may be realized through the detachable connection between the detection bracket 130 and the dust bag bracket 120. Therefore, through the structural arrangement of the bin 100 of this embodiment, it is convenient to improve the manufacturing convenience and assembly convenience of the bin 100 and even the dust collecting device 10 as a whole.

It shall be additionally noted here that, this embodiment provides a possible assembly example based on the arrangement that the moving path of the trigger structure 400 from the initial position, the standby position to the trigger position is basically in a straight line. Specifically, the elastic member 600 is first sleeved on the outer circumferential side of the guide post 440, and then the end of the guide post 440 is inserted into the limiting hole 131. Based on this, the elastic member 600 elastically abuts between a side of the detection bracket 130 facing the trigger body 430 and the trigger body 430, and the moving path of the trigger structure 400 will be basically in a straight line based on the plug-in fit relationship between the guide post 440 and the limiting hole 131.

Therefore, when the dust bag assembly 200 is put back into the bin 100, the first force application part 211 may push against the trigger structure 400, such that the trigger structure 400 moves from the initial position to the standby position along the through direction of the limiting hole 131. Then, the bin cover 300 covers the bin 100, and the second force application part 310 may push against the second force bearing part 420 to continue to move in the same direction, such that the trigger structure 400 further moves from the standby position to the trigger position. Therefore, the trigger structure 400 may immediately press the detector 500, such that the detector 500 is switched from the untriggered state to the triggered state, and then the controller 510 immediately releases the restriction on the dust collecting device 10. During this period, the elastic member 600 generates compressive elastic deformation and accumulates force.

On the contrary, when the bin cover 300 is uncovered to open the bin 100, the second force application part 310 releases the push against the second force bearing part 420, and the elastic part 600 may recover a part of elastic deformation and urge the trigger structure 400 to immediately reset from the trigger position to the standby position, so as to urge the detector 500 to immediately switch from the triggered state to the untriggered state and restrict the operation of the dust collecting device 10. Then, the dust bag assembly 200 is taken out from the bin 100, the first force application part 211 releases the push against the trigger structure 400, and the elastic member 600 may basically restore the elastic deformation and further urge the trigger structure 400 to reset from the standby position to the initial position, so as to facilitate the progress of the next correlated detection work.

Therefore, with the above scheme, the moving path of the trigger structure 400 may be guided, such that it is convenient to improve the smoothness of the activity of the trigger structure 400 and make it convenient for the trigger structure 400 to reset. Furthermore, the risk of getting stuck for the trigger structure 400 may be further reduced, and the reliability and usability may be further improved.

Embodiment 2

This embodiment differs from Embodiment 1 in that:

Referring to FIG. 5 and FIG. 6, in this embodiment, the first force application part 211 pushes the first force bearing part 410 to move from the initial position to the standby position in the first direction, and the second force application part 310 pushes the second force bearing part 420 to move from the standby position to the trigger position in the second direction, wherein the first direction is a horizontal direction and the second direction is a vertical direction.

With the above scheme, the trigger structure 400 may move from the initial position to the standby position in the first direction under the pushing action of the first force application part 211, then move from the standby position to the trigger position in the second direction perpendicular to the first direction under the pushing action of the second force application part 310, and trigger the detector 500. According to the arrangement of the moving path of the trigger position in this embodiment, the triggering of the detector 500 as well as the release of the triggering of the detector 500 can also be reliably realized.

Figure 8:
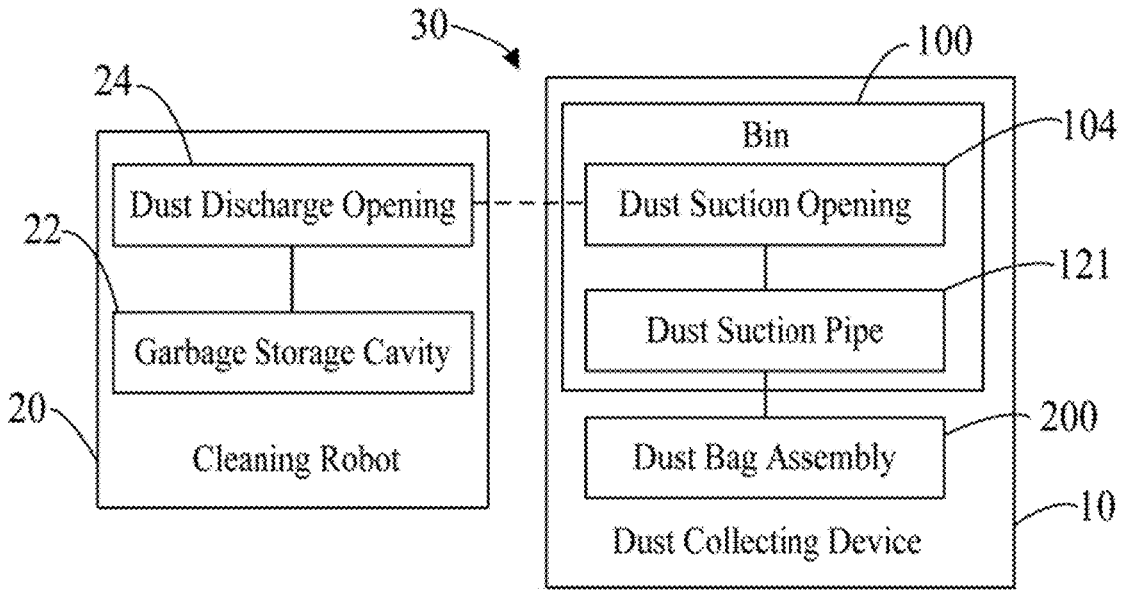
FIG. 8 is a functional block view of a cleaning robot system provided by another embodiment of the present disclosure.

Referring to FIG. 8, another embodiment of the present disclosure further provides a cleaning robot system 30, which includes a cleaning robot 20 and the dust collecting device 10 of the above-mentioned embodiments.

The cleaning robot 20 may be a household or commercial service robot with functions of cleaning and collecting garbage, such as a sweeper, a sweeping and mopping all-in-one machine, a floor washer, a floor scrubber or the like. Specifically, the cleaning robot 20 defines a garbage storage cavity 22 and a dust discharge opening 24, and the dust discharge opening 24 is communicated with the garbage storage cavity 22. The bin 100 defines a dust suction opening 104, and the dust suction opening 104 is communicated with the dust suction pipe 121. when the cleaning robot 20 works, impurities such as dust, hair or paper scraps in the cleaned area may be collected and stored in the garbage storage cavity 22 inside the cleaning robot 20. Therefore, after the cleaning robot 20 works for a period of time, the dust discharge opening 24 of the cleaning robot 20 may be aligned with and communicated with the dust suction opening 104, such that when the dust collecting device 10 works, the impurities originally stored in the garbage storage cavity 22 inside the cleaning robot 20 may be suctioned into the dust bag assembly 200 through the dust discharge opening 24, the dust suction opening 104 and the dust suction pipe 121, thus completing the transfer and collection of the impurities. When the dust collecting device 10 stops working, the operator may uncover the bin cover 300 and open the bin 100, then take the dust bag assembly 200 out of the bin 100 and clean up the impurities in the dust bag assembly 200. After finishing the cleaning-work, the dust bag assembly 200 may be put back into the bin 100 again for the next work of the dust collecting device 10.

What described above are only the exemplary embodiments of the present disclosure, but are not intended to limit the scope of the present disclosure. Any modification, equivalent substitution or improvement made within the spirit and principles of the present disclosure shall be included in the protection scope of the present disclosure.

What is claimed is:

1. A dust collecting device, comprising:

a bin;

a dust bag assembly, detachably installed in the bin;

a bin cover, capable of covering or opening the bin;

a trigger structure;

a detector; and a controller, all of the trigger structure, the detector and the controller arranged in the bin, the trigger structure capable of moving between an initial position in which the trigger structure does not trigger the detector and a trigger position in which the trigger structure triggers the detector; when the dust bag assembly is installed in the bin and the bin cover covers the bin, the dust bag assembly and the bin cover respectively pushing the trigger structure, such that the trigger structure moves from the initial position to the trigger position and triggers the detector; the controller electrically connected with the detector, the controller restricting an operation of the dust collecting device according to an untriggered state of the detector, and the controller releasing a restriction on the operation of the dust collecting device according to a triggered state of the detector.

2. The dust collecting device of claim 1, wherein the trigger structure is capable of moving to a standby position in which the trigger structure does not trigger the detector, the standby position is located between the initial position and the trigger position; the dust bag assembly is installed in the bin to push the trigger structure to move from the initial position to the standby position, such that the bin cover is capable of pushing the trigger structure to continue to move from the standby position to the trigger position when covering the bin.

3. The dust collecting device of claim 2, wherein the trigger structure comprises a first force bearing part, the first force bearing part is located at a side of the trigger structure that is close to the dust bag assembly, the dust bag assembly comprises a connection plate detachably connected to the bin and provided with a first force application part, the first force application part moves to the initial position as the connection plate is installed in the bin, so as to push the first force bearing part to move from the initial position to the standby position; the trigger structure comprises a second force bearing part, the second force bearing part is located at a side of the trigger structure that is close to a top of the bin, the bin cover comprises a second force application part, the second force application part is located at a side of the bin cover that is close to the top of the bin, and the second force application part moves to the standby position as the bin cover covers the top of the bin, so as to push the second force bearing part to move from the standby position to the trigger position.

4. The dust collecting device of claim 3, wherein the bin comprises an installation sidewall and defines a plate groove on the installation sidewall, the first force bearing part is arranged through the installation sidewall at the initial position, and the connection plate is detachably installed in the plate groove and attached to the installation sidewall, so as to push the first force bearing part to draw back relative to the installation sidewall.

5. The dust collecting device of claim 3, wherein at least one of the first force bearing part and the first force application part comprises a first guide surface, the first guide surface is obliquely arranged relative to a preset horizontal direction and is configured to guide the first force application part to exert a first horizontal force to the first force bearing part.

6. The dust collecting device of claim 5, wherein at least one of the second force bearing part and the second force application part comprises a second guide surface, the second guide surface is obliquely arranged relative to the preset horizontal direction and is configured to guide the second force application part to exert a second horizontal force to the second force bearing part, and the second horizontal force is consistent with the first horizontal force in direction.

7. The dust collecting device of claim 3, wherein the first force application part is convexly arranged at a side of the connection plate that is close to the trigger structure, and/or the second force application part is convexly arranged at a side of the bin cover that is close to the trigger structure.

8. The dust collecting device of claim 3, wherein the first force application part pushes the first force bearing part to move from the initial position to the standby position along a first direction, and the second force application part pushes the second force bearing part to move from the standby position to the trigger position along a second direction, wherein the first direction and the second direction are the same preset horizontal direction, or the first direction is a horizontal direction and the second direction is a vertical direction.

9. The dust collecting device of claim 3, wherein the trigger structure comprises a third force application part configured to press the detector.

10. The dust collecting device of claim 1, further comprising an elastic member, wherein the elastic member is elastically connected with the trigger structure and the bin, so as to provide an elastic restoring force for the trigger structure to move in the direction towards the initial position.

11. The dust collecting device of claim 10, wherein the bin comprises a bin body, a dust bag bracket installed in the bin body, and a detection bracket connected to a side of the dust bag bracket that is away from the dust bag assembly, the detection bracket defines a limiting hole; the trigger structure comprises a trigger body and a guide post connected to a side of the trigger body that faces away from the dust bag assembly, the guide post is slidably fitted in the limiting hole, and the elastic member is elastically connected with the trigger body and the detection bracket.

12. A cleaning robot system, comprising:

a cleaning robot defining a garbage storage cavity and a dust discharge opening, the dust discharge opening communicated with the garbage storage cavity; and the dust collecting device of claim 1, the bin comprising a dust suction pipe configured to communicate with the dust bag assembly, the bin defining a dust suction opening, and the dust suction opening communicated with the dust suction pipe, the dust discharge opening capable of being aligned with and being communicated with the dust suction opening.

* * * * *